US009326612B2

(12) United States Patent
Kim

(10) Patent No.: US 9,326,612 B2
(45) Date of Patent: May 3, 2016

(54) COLLAPSIBLE CHAIR FOR LEISURE

(71) Applicant: OSUNG DURALUMIN CO., LTD., Incheon (KR)

(72) Inventor: Hyun-gil Kim, Goyang-si (KR)

(73) Assignee: OSUNG DURALUMIN CO., LTD., Incheon (KR)

( * ) Notice: Subject to any disclaimer, the term of this patent is extended or adjusted under 35 U.S.C. 154(b) by 0 days.

(21) Appl. No.: 14/659,032

(22) Filed: Mar. 16, 2015

(65) Prior Publication Data

US 2015/0374131 A1 Dec. 31, 2015

(30) Foreign Application Priority Data

Jun. 25, 2014 (KR) ..... 10-2014-0077815

(51) Int. Cl.

| | |
|---|---|
| ***A47C 4/28*** | (2006.01) |
| ***A47C 4/02*** | (2006.01) |
| ***A47C 9/10*** | (2006.01) |
| ***A47C 4/30*** | (2006.01) |

(Continued)

(52) U.S. Cl.

CPC . *A47C 4/022* (2013.01); *A47C 4/28* (2013.01); *A47C 4/30* (2013.01); *A47C 4/42* (2013.01); *A47C 9/10* (2013.01); *A47C 4/00* (2013.01)

(58) Field of Classification Search

CPC ..... A47C 4/00; A47C 4/286; A47C 4/28; A47C 5/06; A47C 9/10; A47C 9/105; A47C 4/022; A47C 4/30; A47C 4/22

USPC ..... 297/45, 42, 59, 16, 1, 16.2, 440.11, 161

See application file for complete search history.

(56) References Cited

U.S. PATENT DOCUMENTS 2,712,349 A * 7/1955 Le Voir ..... A47C 5/06 297/440.11
4,605,261 A * 8/1986 Lee ..... A47C 4/286 297/16.1

(Continued)

FOREIGN PATENT DOCUMENTS

| | | | |
|---|---|---|---|
| JP | 3101781 | U | 6/2004 |
| KR | 101287868 | B1 | 7/2013 |
| KR | 101402858 | B1 | 6/2014 |

OTHER PUBLICATIONS

Korean Notice of Allowance dated Nov. 25, 2014 for application No. KR10-2014-0077815.

(Continued)

*Primary Examiner* — Milton Nelson, Jr.
(74) *Attorney, Agent, or Firm* — Hauptman Ham, LLP

(57) ABSTRACT

Disclosed is a collapsible chair for leisure which includes: rear support poles 112 having insert parts 113 inserted into first coupling holes 102 formed in a main body 101; seatback support poles 111 connected to the insert parts 113 of the rear support poles 112; sub support poles 125 having insert parts 126 inserted into second coupling holes 103 formed in the main body 101; first seat support poles 121 connected to the insert parts 126 of the sub support poles 125; couplers having insertion holes 123, and first and second connect parts 122*a* and 122*b* formed at opposite ends thereof; second seat support poles 124 connected to second connect parts 122*b* of the couplers; front support poles 131 inserted into the insertion holes 123 of the couplers 122; and first and second elastic cables 115 and 128 for elastically connecting the support poles.

3 Claims, 5 Drawing Sheets

(51) Int. Cl.
*A47C 4/42* (2006.01)
*A47C 4/00* (2006.01)

(56) References Cited

U.S. PATENT DOCUMENTS 8,205,934 B2 * 6/2012 Homans ..... A47C 4/02
297/16.1
8,899,686 B1 * 12/2014 Kim ..... A47C 4/02
297/16.1
2012/0104805 A1 * 5/2012 Lah ..... A47C 9/105
297/16.1
2015/0091335 A1 * 4/2015 Lee ..... A47C 3/18
297/16.1

OTHER PUBLICATIONS

Korean Notice of Preliminary Rejection dated Jul. 23, 2014 for application No. 10-2014-0077815.

* cited by examiner

COLLAPSIBLE CHAIR FOR LEISURE

RELATED APPLICATIONS

This application claims priority to Korean Patent Application No. 10-2014-0077815, Jun. 25, 2014 in the Korean Intellectual Property Office, the entire disclosure of which is incorporated herein by reference.

BACKGROUND OF THE INVENTION

1. Field of the Invention

The present invention relates to a collapsible chair for leisure and more specifically to a collapsible chair for leisure which includes: a seat having upper and lower pockets formed on a rear surface thereof to wrap and support back and hip of a user; a main body having first and second coupling holes formed on opposite end portions thereof at a predetermined angle and an interval different from each other; rear support poles whose upper end have insert parts inserted into the first coupling holes to be exposed and rear ends are placed on the ground; seatback support poles whose upper ends are inserted into the upper pockets and lower ends are connected to the exposed insert parts of the rear support poles; sub support poles whose front ends have insert parts inserted into the second coupling holes to be exposed lower ends and rear ends are placed on the ground at a predetermined angle with the rear support poles; couplers having first and second connecting parts formed at opposite ends thereof and insertion holes formed substantially orthogonal to the first and second connecting parts; first seat support poles whose rear ends are connected to the exposed insert parts of the sub support poles and front ends are connected to the first connecting parts of the couplers; second seat support poles whose rear ends are connected to the second connecting parts of the couplers and front ends are inserted into the lower pockets; first elastic cables whose upper ends are fixed into the seatback support poles and lower ends are fixed into the rear support poles so as to elastically connect these support poles in a vertical direction with being inserted into the first coupling holes; and second elastic cables whose front ends are fixed to the first connect parts of the couplers and rear ends are fixed into the sub support poles so as to elastically connect these support poles in horizontal direction with being inserted into the second coupling holes, thereby it is possible to be easily installed and folded in the field and provide a stable and strong outdoor chair by using a four-point supporting structure of the two rear support poles and two sub support poles which have rubber caps disposed at lower ends thereof with relaxed and comfortable seating sensation.

2. Description of the Related Art

As a portable chair, there is a "collapsible chair for leisure" disclosed in Korea Patent Registration No. 10-1176740 which is issued to the present applicant.

The above-described collapsible chair includes: a main body; couplers which are fixed to opposite ends of a main body and have insertion holes and coupling holes; front support poles and rear support poles whose one end is inserted into the insertion hole of the couplers to support a user seated thereon while contacting ground; first elastic cables whose one end is fixed to a front cap of the front support pole and whose the other end is fixed to a rear cap of the rear support pole, respectively, so as to elastically connect the front and rear support poles with being inserted into the insertion holes of the couplers; seatback support poles whose lower ends are inserted into the coupling holes of the couplers and slantly stand upward; second elastic cables whose one end is fixed to a side cap of the seatback support poles and the other end is fixed to a coupling cap inserted into the coupling hole of the couplers, respectively, so as to elastically connect the seatback support poles to the main body with being inserted into the insertion holes of the couplers; a rectangular seat having upper insertion pockets formed at upper end portions to be inserted the upper ends of the seatback support poles, and lower insertion pockets formed at lower end portions to be inserted the front support poles; clips which are fixed to the rear surface of the seat by sewing and detachably coupled to the main body so as to prevent the lower insertion pockets of the seat from being separated; front and rear legs which are connected to the front and rear support poles through connectors so that the front and rear support poles coupled to the couplers are stably installed on ground at a constant interval.

In the above-described collapsible chair, the seat is installed and used away from the ground by the front and rear legs connected to the front and rear support poles, such that it is possible to protect the user from moisture and cold air, compared to a conventional chair without legs.

However, since the above-described collapsible chair has the U-shaped legs disposed at both of front and rear portions of the chair, contact area with the ground is increased. Therefore, shaking or unbalance may occur depending on the circumstances of the ground on which the chair is installed, and thereby seating sensation may be reduced.

SUMMARY OF THE INVENTION

In consideration of the above-described circumstances, it is an object of the present invention to provide a collapsible chair for leisure which includes rear support poles having insert parts inserted into first coupling holes formed in a main body; seatback support poles connected to the insert parts of the rear support poles so as to easily couple these poles and provide a reliably coupling structure as well as comfortably support a user by the elastic force of the seatback support pole; sub support poles having insert parts inserted into second coupling holes formed in the main body; first seat support poles connected to the insert parts of the sub support poles so as to easily couple these poles and provide a reliably coupling structure as well as comfortably support the user by the elastic force of the first seat support pole; couplers having insertion holes, and first and second connect parts formed at opposite ends thereof substantially orthogonal to the insertion holes; second seat support poles connected to second connect parts of the couplers; front support poles inserted into the insertion holes of the couplers; and first and second elastic cables for elastically connecting the support poles, thereby it is possible to be easily installed and folded in the field and provide a stable and strong outdoor chair by using a four-point supporting structure of the two rear support poles and two sub support poles which have rubber caps disposed at lower ends thereof with relaxed and comfortable seating sensation.

In order to achieve the above-described object, there is provided a collapsible chair including: a seat which has upper pockets and lower pockets formed on a rear surface at upper and lower corner portions thereof and supports back and hip of a user; a main body which has first and second coupling holes formed on opposite end portions thereof at a predetermined angle in a lateral direction thereof and an interval in a longitudinal direction thereof with each other; rear support poles whose upper ends have insert parts inserted into the first coupling holes of the main body to be exposed from an outer periphery thereof and lower ends are placed on ground; seatback support poles whose upper ends are inserted into the upper pockets of the seat and lower ends are connected to the exposed insert parts of the rear support poles; sub support poles whose upper ends have insert parts inserted into the second coupling holes of the main body to be exposed from the outer periphery thereof and rear ends are placed on the ground at a predetermined angle with the rear support poles; couplers having first and second connecting parts formed at opposite ends thereof; first seat support poles whose rear ends are connected to the exposed insert parts of the sub support poles and front ends are connected to the first connecting parts of the couplers; and second seat support poles whose rear ends are connected to the second connecting parts of the couplers and front ends are inserted into the lower pockets of the seat.

Preferably, the collapsible chair further includes: first elastic cables whose upper ends are fixed into the seatback support poles and lower ends are fixed into the rear support poles so as to elastically connect the seatback support poles and the rear support poles in a vertical direction, with being inserted into the first coupling holes of the main body; second elastic cables whose front ends are fixed to the first connect parts of the couplers and rear ends are fixed into the sub support poles so as to elastically connect the sub support poles and the second seat support poles in horizontal direction, with being inserted into the second coupling holes of the main body; first rubber caps which are fixed to the ends of the rear support poles disposed on the ground; and second rubber caps which are fixed to the ends of the sub support poles disposed on the ground.

Preferably, the collapsible chair for leisure according to claim 1, further includes: front support poles having insert parts at opposite ends thereof so as to be inserted into insertion holes of the couplers, wherein the insertion holes are formed in the couplers substantially orthogonal to the first and second connecting parts.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail with reference to the accompanying drawings.

Figure 1:
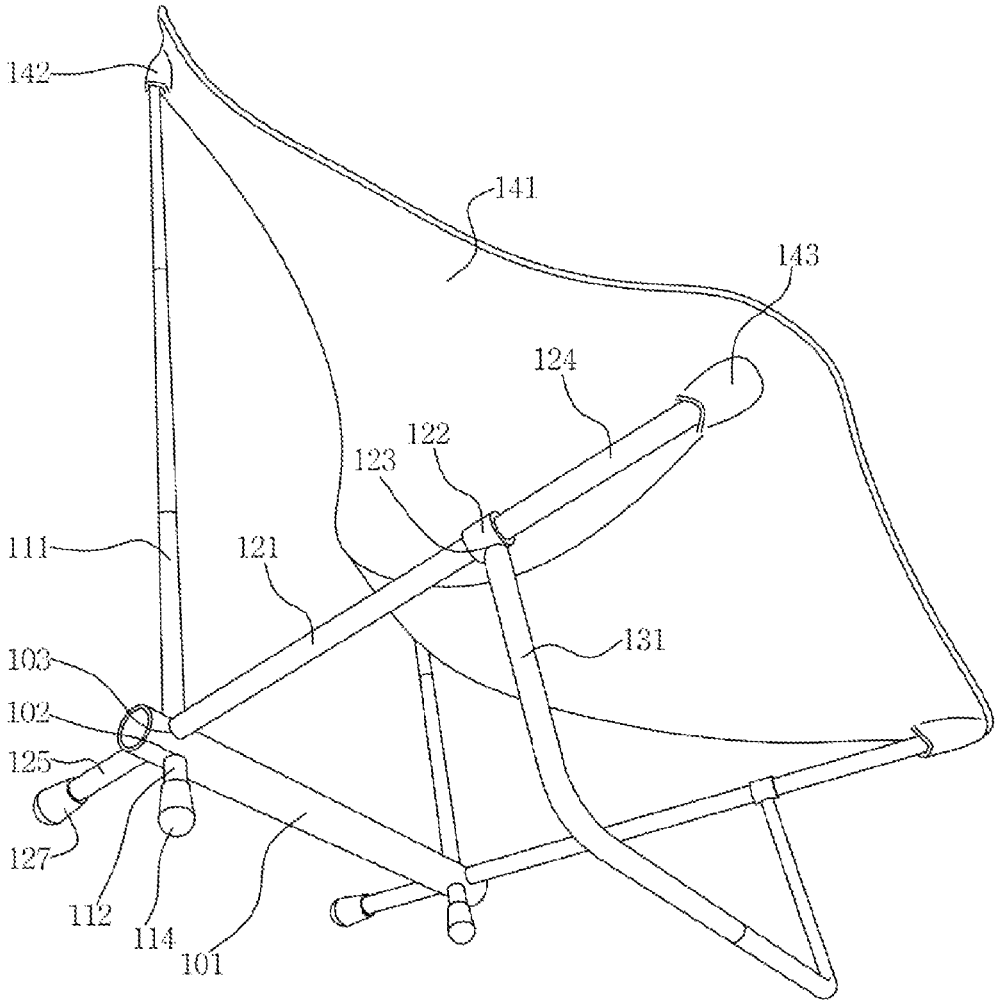
FIG. 1 is a bottom perspective view illustrating a collapsible chair for leisure according to the present invention.
Figure 2:
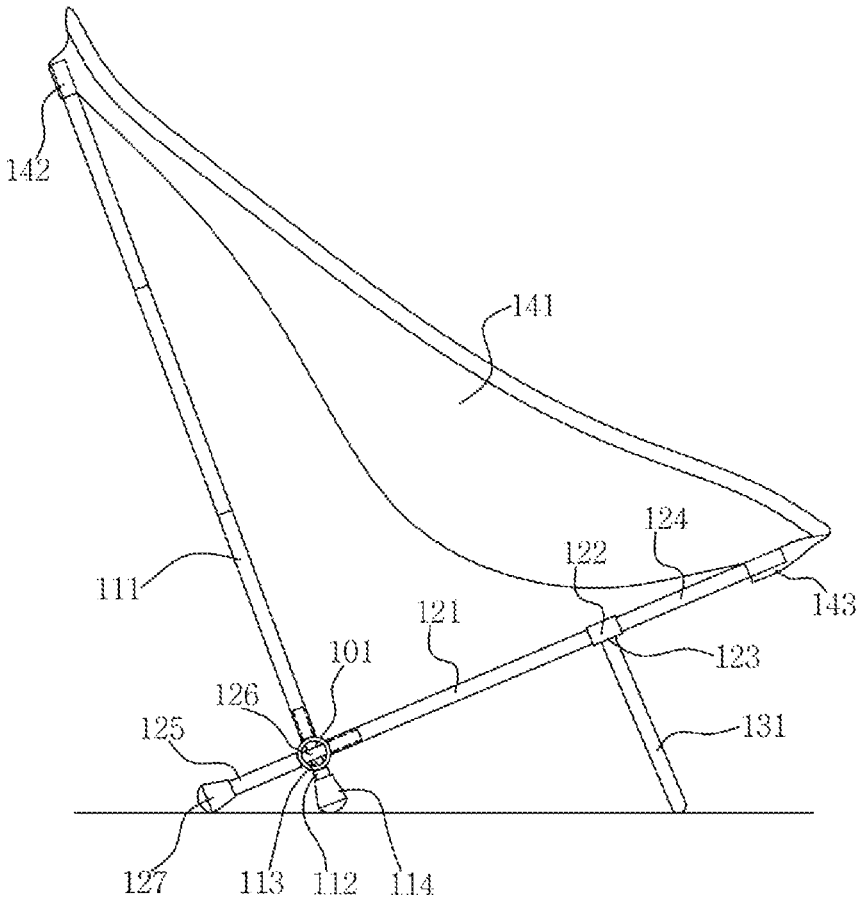
FIG. 2 is a side view illustrating the collapsible chair according to the present invention.

As illustrated in FIGS. 1 and 2, a collapsible chair for leisure according to the present invention generally includes a seat 141 on which a user is seated, seatback support poles 111 and first and second seat support poles 121 and 124 which are substantially disposed at right angles to support back and hip of the user seated on the seat 141, a main body 101 to which the seatback and the first and second seat support poles 111, 121 and 124, rear support poles 112 which are connected to the seatback support poles 111 through the main body 101, sub support poles 125 which are connected to the first seat support poles 121 through the main body 101, couplers 122 which connect the first seat support poles 121 and the second seat support poles 124, and front support poles 131 which are connected to the couplers 122.

In the present disclosure, upside and downside in drawings are referred to as upper and lower of the chair, and right and left in drawings are referred to as front and rear of the chair, respectively.

Herein, the front support poles 131 may have different lengths so as to be replaced depending on a body condition of the user.

In addition, the rear support poles 112 and the sub support poles 125 have caps 114 and 127 made of a flexible material, such as rubber, so as to elastically support the chair and provide a four-point supporting structure of the present invention.

Figure 3:
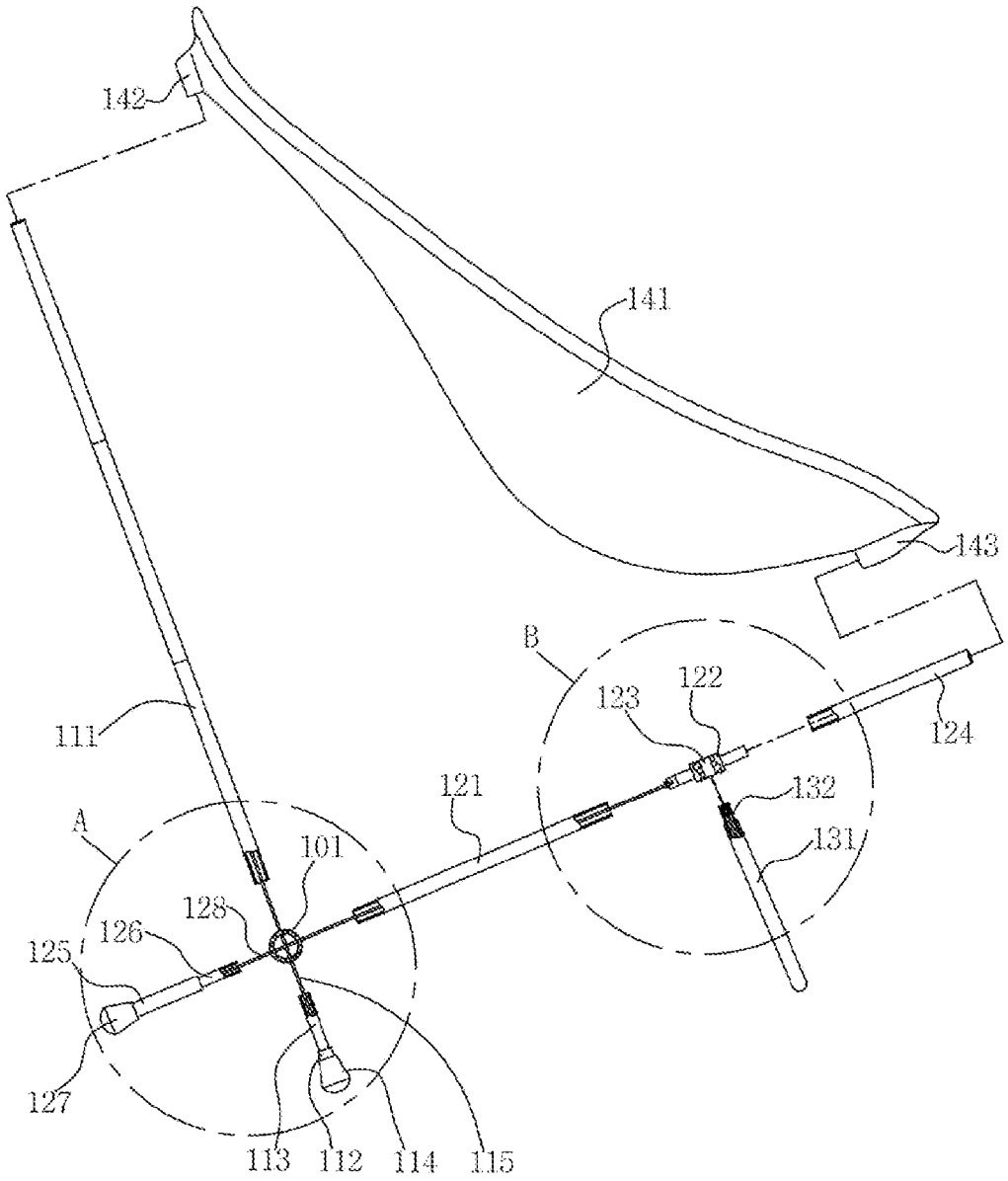
FIG. 3 is an exploded view for describing the configuration of the collapsible chair according to the present invention.
Figure 4:
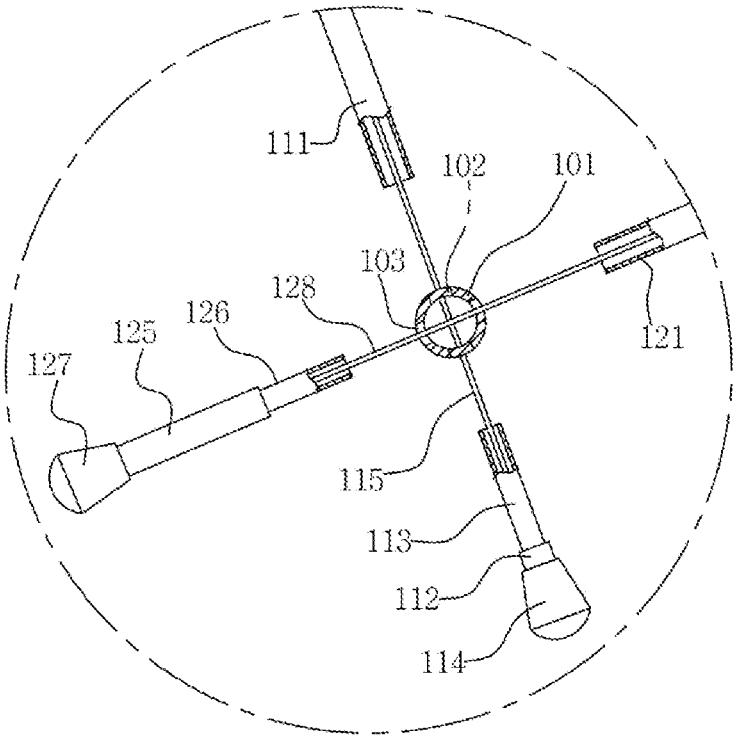
FIG. 4 is an enlarged view of A part in FIG. 3 for describing the connection configuration of first and second elastic cables with support poles of the present invention.
Figure 5:
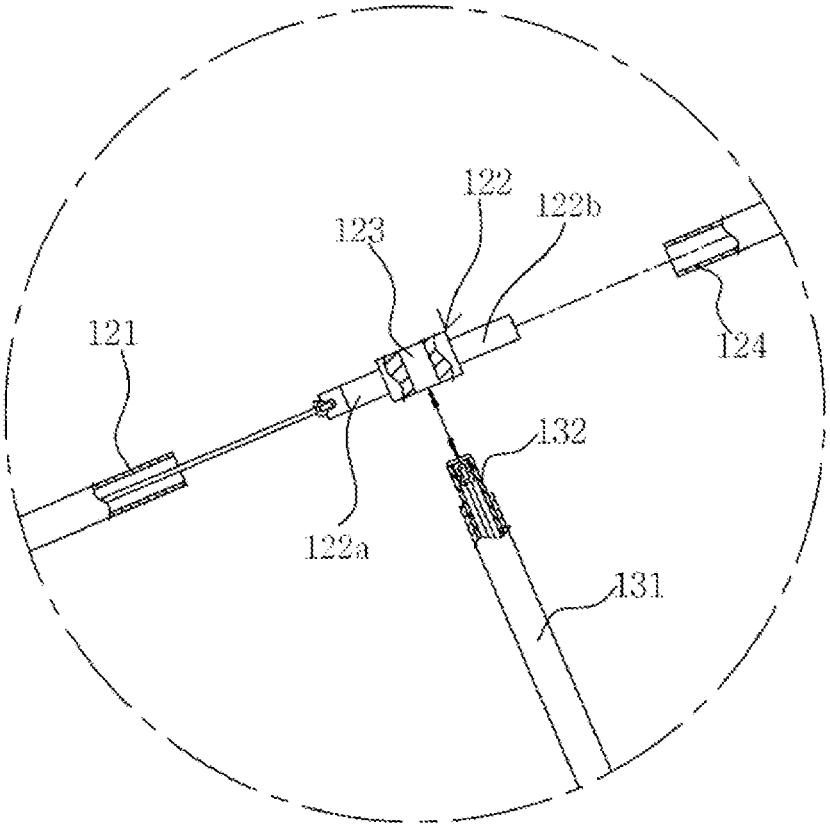
FIG. 5 is an enlarged view of B part in FIG. 3 for describing the connection configuration of first and second seat support poles with first support poles of the present invention.

As illustrated in FIGS. 3 to 5, the seat 141 has upper pockets 142 and lower pockets 143 formed on a rear surface at upper and lower corner portions thereof. When using the chair, the upper ends of the seatback support poles 111 are inserted into the upper pockets 142, and the front end of the second seat support poles 124 are inserted into the lower pockets 143.

The main body 101 has first and second coupling holes 102 and 103 which are formed on opposite end portions thereof at a predetermined angle in a lateral direction thereof and an interval in a longitudinal direction thereof with each other.

The rear support poles 112 have insert parts 113 formed as upper ends thereof, which are inserted into the first coupling holes 102 of the main body 101 to be exposed. Lower ends of the rear support poles 112 are placed on ground through first rubber caps 114.

As described above, the upper ends of the seatback support poles 111 are inserted into the upper pockets 142 of the seat 114 and the lower ends are connected to the exposed insert parts 113 of the rear support poles 112.

The sub support poles 125 have insert parts 126 as upper ends, which are inserted into the second coupling holes 103 of the main body 101 to be exposed. Rear ends of the sub support poles 125 are placed on the ground at a predetermined angle with the rear support poles 125, and preferably, at a right angle.

The couplers 122, which connect the first and second seat support poles 121 and 124, have first and second connecting parts **122*a* and 122*b* formed at opposite ends thereof, and insertion holes 123 are formed in the couplers 122 substantially orthogonal to the first and second connecting parts 122*a* and 122*b*, as illustrated in FIG. 5**.

Rear ends of the first seat support poles 121 are connected to the exposed insert parts 126 of the sub support poles 125 and front ends thereof are connected to the first connecting parts **122*a* of the couplers 122**.

Rear ends of the second seat support poles are connected to the second connecting parts **122*b* of the couplers 122 and front ends thereof are inserted into the lower pockets 143 of the seat 141**.

The collapsible chair for leisure according to the present invention further includes first elastic cables 115 and second elastic cables 128.

The first elastic cables 115 are configured to elastically connect the seatback support pole 111 and the rear support poles 112 in a vertical direction with being inserted into the first coupling holes 102 of the main body 101. Upper ends of the first elastic cables 115 are fixed into the seatback support pole 111 and the lower ends thereof are fixed into the rear support pole 112, while middle portions thereof passing through the first coupling holes 102 of the main body 101.

The second elastic cables 128 are configured to elastically connect the sub support poles 125 and the first seat support poles 124 through the couplers 122 in a horizontal direction with being inserted into the second coupling holes 103 of the main body 101.

Front ends of the second elastic cables 128 are fixed to the first connect parts 122*a* of the couplers 122 and rear ends are fixed into the sub support poles 125 while middle portions thereof passing through the first seat support poles 121 and the second coupling holes 103 so as to elastically connect the sub support poles 125 and the second seat support poles 124 through the couplers 122.

The first rubber caps 114 are fixed to the ends of the rear support poles 112 disposed on the ground; and the second rubber caps 127 are fixed to the ends of the sub support poles 125 disposed on the ground.

The front support poles 131 have insert parts 132 at opposite ends thereof so as to be inserted into insertion holes 123 of the couplers 122 substantially orthogonal to the first and second seat support poles 121 and 124.

Next, an operation of the collapsible chair of the present invention having the above-described configuration will be described in detail.

In the collapsible chair according to the present invention, FIG. 1 is a bottom perspective view illustrating the collapsible chair for leisure according to the present invention, and FIG. 2 is a side view illustrating the collapsible chair according to the present invention.

When assembling the collapsible chair, the upper ends of the insert parts 113 are inserted into the first coupling holes 102 formed at opposite end portions of the main body 101 to be exposed to the upside from the outer periphery of the main body 101, and the lower ends of the seatback support poles 111 are coupled to the exposed insert parts 113. The upper ends of the seatback support poles 111 are inserted into the upper pockets 142 of the seat 141.

In this case, the upper ends of the first coupling holes 102 are fixed to the seatback support poles 111, and the lower ends are fixed into the rear support poles 112, with being inserted into the first coupling holes 102 of the main body 101, so as to prevent the rear support poles 112 and the seatback support poles 111 from being separated during storing or carrying.

In addition, the insert parts 126 of the sub support poles 125 are inserted into the second coupling holes 103 which are formed at opposite end portions of the main body 101 to be exposed to the front from the outer periphery of the main body 101, and the rear ends of the first seat support poles 121 are coupled to the exposed insert parts 126. The front ends of the first seat support poles 121 are connected to the first connecting parts 122*a* of the couplers 122. The rear ends of the second seat support poles 124 coupled to the second connecting parts 122*b*, and the front ends thereof are inserted into the lower pockets 143 of the seat 141.

The rear ends of the second elastic cables 128 are fixed into the sub support poles 125 and the front ends thereof are fixed to the first connecting parts 122*a* of the couplers 122 passing through the first seat support poles 121, with being inserted into the second coupling holes 103 of the main body 101, so as to prevent the sub support poles 125 and the first seat support poles 121 from being separated during storing or carrying.

Mean while, the first rubber caps 114 are mounted on the lower ends of the rear support poles 112 which are inserted into the first coupling holes 102 of the main body 101 through the insert parts 113, and the second rubber caps 127 are mounted on the rear ends of the sub support poles 125 which are inserted into the second coupling holes 103 of the main body 101 through the insert parts 126. Since the first rubber caps 114 and the second rubber caps 127 disposed on the ground supports the collapsible chair, as illustrated in FIGS. 1 and 2, the collapsible chair is supported at a total of four places, and thereby it is possible to more stably and reliably support the collapsible chair.

As described above, according to the collapsible chair for leisure, since the rear support poles having insert parts are inserted into the first coupling holes formed in the main body, and the seatback support poles are connected to the insert parts of the rear support poles so as to easily couple the rear support poles and the seatback support poles and provide a reliably coupling structure as well as comfortably support a user by the elastic force of the seatback support pole.

According to the collapsible chair for leisure, since the sub support poles having insert parts inserted into second coupling holes formed in the main body; first seat support poles connected to the insert parts of the sub support poles so as to easily couple the sub support poles and the first set support poles and provide a reliably coupling structure as well as comfortably support the user by the elastic force of the first seat support pole.

According to the collapsible chair for leisure, since the couplers have the insertion holes, and the first and second connect parts formed at opposite ends thereof substantially orthogonal to the insertion holes; the second seat support poles are connected to second connect parts of the couplers; the front support poles are inserted into the insertion holes of the couplers; and first and second elastic cables are elastically connect the support poles, thereby it is possible to be easily installed and folded in the field and provide a stable and strong outdoor chair by using the four-point supporting structure of the two rear support poles and two sub support poles which have rubber caps disposed at lower ends thereof with relaxed and comfortable seating sensation.

While the present invention has been described with reference to the preferred embodiments, it will be understood by those skilled in the related art that various modifications and variations may be made therein without departing from the scope of the present invention as defined by the appended claims.

What is claimed is:

1. A collapsible chair for leisure comprising:

a seat which has upper pockets and lower pockets formed on a rear surface at upper and lower corner portions thereof and supports back and hips of a user;

a main body which has first and second coupling holes formed on opposite end portions thereof at a predetermined angle in a lateral direction thereof and a predetermined width in a longitudinal direction thereof with each other;

rear support poles whose upper ends have insert parts inserted into the first coupling holes of the main body to be exposed from an outer periphery thereof and lower ends are placed on ground;

seatback support poles whose upper ends are inserted into the upper pockets of the seat and lower ends are connected to the exposed insert parts of the rear support poles;

sub support poles whose upper ends have insert parts inserted into the second coupling holes of the main body to be exposed from the outer periphery thereof and rear ends are placed on the ground at a predetermined angle with the rear support poles;

couplers having first and second connecting parts formed at opposite ends thereof;

first seat support poles whose rear ends are connected to the exposed insert parts of the sub support poles and front ends are connected to the first connecting parts of the couplers; and second seat support poles whose rear ends are connected to the second connecting parts of the couplers and front ends are inserted into the lower pockets of the seat.

2. The collapsible chair for leisure according to claim 1, further comprising:

first elastic cables whose upper ends are fixed into the seatback support poles and lower ends are fixed into the rear support poles so as to elastically connect the seatback support poles and the rear support poles in a vertical direction, with being inserted into the first coupling holes of the main body;

second elastic cables whose front ends are fixed to the first connecting parts of the couplers and rear ends are fixed into the sub support poles so as to elastically connect the sub support poles and the second seat support poles in horizontal direction, with being inserted into the second coupling holes of the main body;

first rubber caps which are fixed to the ends of the rear support poles disposed on the ground; and second rubber caps which are fixed to the ends of the sub support poles disposed on the ground.

3. The collapsible chair for leisure according to claim 1, further comprising:

front support poles having insert parts at opposite ends thereof so as to be inserted into insertion holes of the couplers, wherein the insertion holes are formed in the couplers substantially orthogonal to the first and second connecting parts.

* * * * *